US009528759B2

(12) United States Patent
Ransbarger et al.

(10) Patent No.: US 9,528,759 B2
(45) Date of Patent: Dec. 27, 2016

(54) ENHANCED NITROGEN REMOVAL IN AN LNG FACILITY

(75) Inventors: Weldon L. Ransbarger, Houston, TX (US); J. Dale Ortego, Jr., Katy, TX (US)

(73) Assignee: ConocoPhillips Company, Houston, TX (US)

( * ) Notice: Subject to any disclaimer, the term of this patent is extended or adjusted under 35 U.S.C. 154(b) by 1846 days.

(21) Appl. No.: 12/117,364

(22) Filed: May 8, 2008

(65) Prior Publication Data

US 2009/0277217 A1 Nov. 12, 2009

(51) Int. Cl.

| | |
|---|---|
| ***F25J 1/00*** | (2006.01) |
| ***F25J 3/02*** | (2006.01) |
| ***F25J 1/02*** | (2006.01) |

(52) U.S. Cl.

CPC ..... *F25J 3/0209* (2013.01); *F25J 1/004* (2013.01); *F25J 1/0022* (2013.01); *F25J 1/0052* (2013.01); *F25J 1/021* (2013.01); *F25J 1/023* (2013.01); *F25J 1/0238* (2013.01); *F25J 1/0241* (2013.01); *F25J 1/0265* (2013.01); *F25J 1/0283* (2013.01); *F25J 3/0233* (2013.01); *F25J 3/0257* (2013.01); *F25J 2200/02* (2013.01); *F25J 2200/40* (2013.01); *F25J 2200/70* (2013.01); *F25J 2200/78* (2013.01); *F25J 2215/04* (2013.01); *F25J 2220/62* (2013.01);

(Continued)

(58) Field of Classification Search

CPC ..... F25J 1/0022; F25J 1/004; F25J 1/0052; F25J 1/021; F25J 1/023; F25J 1/0238; F25J 1/0241; F25J 1/0283; F25J 3/0209;F25J 3/0233; F25J 3/0257; F25J 3/0265; F25J 2200/02; F25J 2200/70; F25J 2220/62; F25J 2220/64

USPC ..... 62/611, 612, 618–620, 627, 927

See application file for complete search history.

(56) References Cited

U.S. PATENT DOCUMENTS

| | | | |
|---|---|---|---|
| 5,036,671 | A | 8/1991 | Nelson et al. |
| 5,505,049 | A | 4/1996 | Coyle et al. |
| 5,651,269 | A | 7/1997 | Prevost et al. |

(Continued)

FOREIGN PATENT DOCUMENTS

| | | |
|---|---|---|
| WO | WO 02/070972 | 9/2002 |
| WO | WO 2004/015346 | 2/2004 |

(Continued)

OTHER PUBLICATIONS

Egyption Office Action, Office Communication for Egyptian Application No. PCT1893/2010 based on PCT/US2009/037649.

(Continued)

*Primary Examiner* — Frantz Jules
*Assistant Examiner* — Webeshet Mengesha
(74) *Attorney, Agent, or Firm* — ConocoPhillips Company

(57) ABSTRACT

An LNG facility employing an enhanced nitrogen removal system that concentrates the amount of nitrogen in the feed stream to a nitrogen removal unit (NRU) to thereby increase the separation efficiency of the NRU. In one embodiment, the nitrogen removal system comprises a multistage separation vessel operable to separate nitrogen from a cooled natural gas stream. At least a portion of the resulting nitrogen-containing stream exiting the multistage separation vessel can be used as a refrigerant, processed to a nitrogen removal unit, and/or utilized as fuel gas for the LNG facility.

14 Claims, 4 Drawing Sheets

(52) U.S. Cl.
CPC ..... *F25J 2220/64* (2013.01); *F25J 2270/12* (2013.01); *F25J 2270/88* (2013.01)

(56) References Cited

U.S. PATENT DOCUMENTS

| | | | | |
|---|---|---|---|---|
| 6,070,429 | A * | 6/2000 | Low et al. | 62/612 |
| 6,564,578 | B1 | 5/2003 | Fischer-Calderon | |
| 6,758,060 | B2 | 7/2004 | O'Brien | |
| 6,978,638 | B2 | 12/2005 | Brostow et al. | |
| 7,069,744 | B2 * | 7/2006 | Patel et al. | 62/620 |
| 2005/0020434 | A1 | 1/2005 | Ansorge et al. | |
| 2005/0183452 | A1 * | 8/2005 | Hahn et al. | 62/620 |
| 2006/0130521 | A1 * | 6/2006 | Patel | 62/620 |
| 2007/0056318 | A1 * | 3/2007 | Ransbarger | 62/611 |

FOREIGN PATENT DOCUMENTS

| | | |
|---|---|---|
| WO | WO 2005/061978 | 7/2005 |
| WO | WO 2005/081793 | 9/2005 |

OTHER PUBLICATIONS

Canadian Office Action, Office Communication for Canadian Application No. 2,719,647.

* cited by examiner

ENHANCED NITROGEN REMOVAL IN AN LNG FACILITY

BACKGROUND OF THE INVENTION

1. Field of the Invention

This invention relates to methods and apparatuses for liquefying natural gas. In another aspect, the invention concerns an LNG facility employing an enhanced nitrogen removal system.

2. Description of the Related Art

Cryogenic liquefaction is commonly used to convert natural gas into a more convenient form for transportation and/or storage. Because liquefying natural gas greatly reduces its specific volume, large quantities of natural gas can be economically transported and/or stored in liquefied form.

Transporting natural gas in its liquefied form can effectively link a natural gas source with a distant market when the source and market are not connected by a pipeline. This situation commonly arises when the source of natural gas and the market for the natural gas are separated by large bodies of water. In such cases, liquefied natural gas (LNG) can be transported from the source to the market using specially designed ocean-going LNG tankers.

Storing natural gas in its liquefied form can help balance out periodic fluctuations in natural gas supply and demand. In particular, LNG can be "stockpiled" for use when natural gas demand is low and/or supply is high. As a result, future demand peaks can be met with LNG from storage, which can be vaporized as demand requires.

Several methods exist for liquefying natural gas. Some methods produce a pressurized LNG (PLNG) product that is useful, but requires expensive pressure-containing vessels for storage and transportation. Other methods produce an LNG product having a pressure at or near atmospheric pressure. In general, these non-pressurized LNG production methods involve cooling a natural gas stream via indirect heat exchange with one or more refrigerants and then expanding the cooled natural gas stream to near atmospheric pressure. In addition, most LNG facilities employ one or more systems to remove contaminants (e.g., water, acid gases, nitrogen, and ethane and heavier components) from the natural gas stream at different points during the liquefaction process.

Frequently, the natural gas stream introduced into the LNG facility can have a relatively high concentration of nitrogen. High nitrogen concentrations in the natural gas feed stream can present several operational problems as the gas is subjected to liquefaction in an LNG facility. For example, the natural gas can be difficult to condense, thereby increasing the compressor horsepower requirements. Liquefying natural gas having an increased nitrogen concentration can also lead to larger volumes of off-spec LNG and lower quality fuel gas for use within the facility. Problems with high-nitrogen natural gas can be further exacerbated when the LNG facility employs one or more open-loop refrigeration cycles that utilize at least a portion of the natural gas feed stream as a refrigerant.

Although highly desirable and even necessary in some cases, conventional processes of removing nitrogen from the natural gas liquefied in an LNG facility can be expensive. Typical nitrogen removal units (NRUs) process large volumes of methane-containing intermediate process streams having relatively dilute, but nonetheless undesirable, concentrations of nitrogen. Processing these larger volumes of more nitrogen-dilute process streams increases the overall cost of nitrogen removal, in terms of capital, maintenance, and operating costs. In order to minimize costs and maximize profit, a more efficient process for removing nitrogen from an LNG system is desirable.

SUMMARY OF THE INVENTION

In one embodiment of the present invention, there is provided a process for liquefying a natural gas stream, the process comprising: (a) cooling at least a portion of the natural gas stream in a first heat exchanger of a first upstream refrigeration cycle via indirect heat exchange with a first pure-component refrigerant to thereby provide a cooled natural gas stream; (b) cooling at least a portion of the cooled natural gas stream in a cooling pass of a second heat exchanger in an open-loop methane refrigeration cycle to thereby provide a cooled predominantly methane stream; (c) separating at least a portion of the cooled predominantly methane stream in a multistage separation vessel to thereby provide a predominantly vapor stream and a predominantly liquid stream; and (d) passing at least a portion of the predominantly vapor stream through a warming pass of the second heat exchanger to thereby accomplish at least a portion of the cooling of step (b), wherein the multistage separation vessel is positioned downstream of the cooling pass and upstream of the warming pass of the second heat exchanger, wherein the nitrogen mole fraction of the predominantly vapor stream is at least about 1.25 times greater than the nitrogen mole fraction of the cooled predominantly methane stream introduced into the multistage separation vessel.

In another embodiment of the present inventions there is provided a process for liquefying a natural gas stream in an LNG facility, the process comprising: (a) cooling the natural gas stream in an upstream refrigeration cycle to thereby provide a cooled natural gas stream; (b) separating at least a portion of the cooled natural gas stream in a heavies removal column to thereby provide a predominantly methane overhead stream and a bottoms stream; (c) cooling at least a portion of the predominantly methane overhead stream in a heat exchanger of an open-loop methane refrigeration cycle to thereby provide a cooled predominantly methane stream; (d) flashing at least a portion of the cooled predominantly methane stream to thereby provide a two-phase predominantly methane stream; (e) separating at least a portion of the two-phase predominantly methane stream in a multistage separation vessel to thereby produce a predominantly vapor stream and a predominantly liquid stream; (f) passing at least a portion of the predominantly vapor stream through the heat exchanger to thereby accomplish at least a portion of the cooling of step (c), wherein the at least a portion of the predominantly vapor stream passed through the heat exchanger is withdrawn from the heat exchanger as a warmed vapor stream; (g) dividing at least a portion of the warmed vapor stream into a refrigerant fraction and a removed fraction; (h) compressing at least a portion of the refrigerant fraction in a methane compressor of the open-loop methane refrigeration cycle to thereby produce a compressed refrigerant stream; (i) cooling at least a portion of the compressed refrigerant stream in the upstream refrigeration cycle to thereby produce a cooled refrigerant stream; and (j) introducing at least a portion of the cooled refrigerant stream into the multistage separation vessel as a separation-enhancing stream.

In yet another embodiment of the present invention, there is provided a facility for liquefying a stream of natural gas. The facility comprises a first refrigeration cycle, a second refrigeration cycle, and a multistage separation vessel. The first refrigeration cycle comprises a first heat exchanger that comprises a first cooling pass defining a first warm fluid inlet and a first cool fluid outlet. The second refrigeration cycle comprises a second heat exchanger that defines a second cooling pass and a second warming pass. The second cooling pass defines a second warm fluid inlet and a second cool fluid outlet, while the second warming pass defines a second cool fluid inlet and a second warm fluid outlet. The multistage separation vessel defines a first fluid inlet, an upper vapor outlet, and a lower liquid outlet. The multistage separation vessel is positioned downstream of the first cooling pass of the first heat exchanger and is positioned upstream of the second warming pass of the second heat exchanger. The first cool fluid outlet of the first cooling pass is in fluid flow communication with the second warm fluid inlet of the second cooling pass. The second cool fluid outlet of the second cooling pass is in fluid flow communication with the first fluid inlet of the multistage separation vessel. The upper vapor outlet of the multistage separation vessel is in fluid flow communication with the second cool fluid inlet of the second warming pass.

BRIEF DESCRIPTION OF THE FIGURES

Certain embodiments of the present invention are described in detail below with reference to the enclosed figures, wherein.

DETAILED DESCRIPTION

The present invention can be implemented in a facility used to cool natural gas to its liquefaction temperature to thereby produce liquefied natural gas (LNG). In general, the LNG facility comprises a plurality of refrigeration cycles that employ one or more refrigerants to extract heat from the natural gas and then reject the heat to the environment. In one embodiment, the LNG facility in which the present invention is incorporated into or used in combination with can comprise at least one, at least two, or at least three or more refrigeration cycles. Numerous configurations of LNG systems exist, and the present invention may be implemented in many different types of LNG systems.

In one embodiment, the present invention can be implemented in a mixed refrigerant LNG system. Examples of mixed refrigerant processes can include, but are not limited to, a single-loop refrigeration system using a mixed refrigerant, a propane pre-cooled mixed refrigerant system, and a dual mixed refrigerant system. Some mixed refrigerant systems can also include one or more pure component refrigeration cycles.

In another embodiment, the present invention is implemented in a cascade LNG system employing a cascade-type refrigeration process using one or more pure component refrigerants. The refrigerants utilized in cascade-type refrigeration processes can have successively lower boiling points in order to maximize heat removal from the natural gas stream being liquefied. Additionally, cascade-type refrigeration processes can include some level of heat integration. For example, a cascade-type refrigeration process can cool one or more refrigerants having a higher volatility via indirect heat exchange with one or more refrigerants having a lower volatility. In addition to cooling the natural gas stream via indirect heat exchange with one or more refrigerants, cascade and mixed-refrigerant LNG systems can employ one or more expansion cooling stages to simultaneously cool the LNG while reducing its pressure to near atmospheric pressure.

Figure 1:
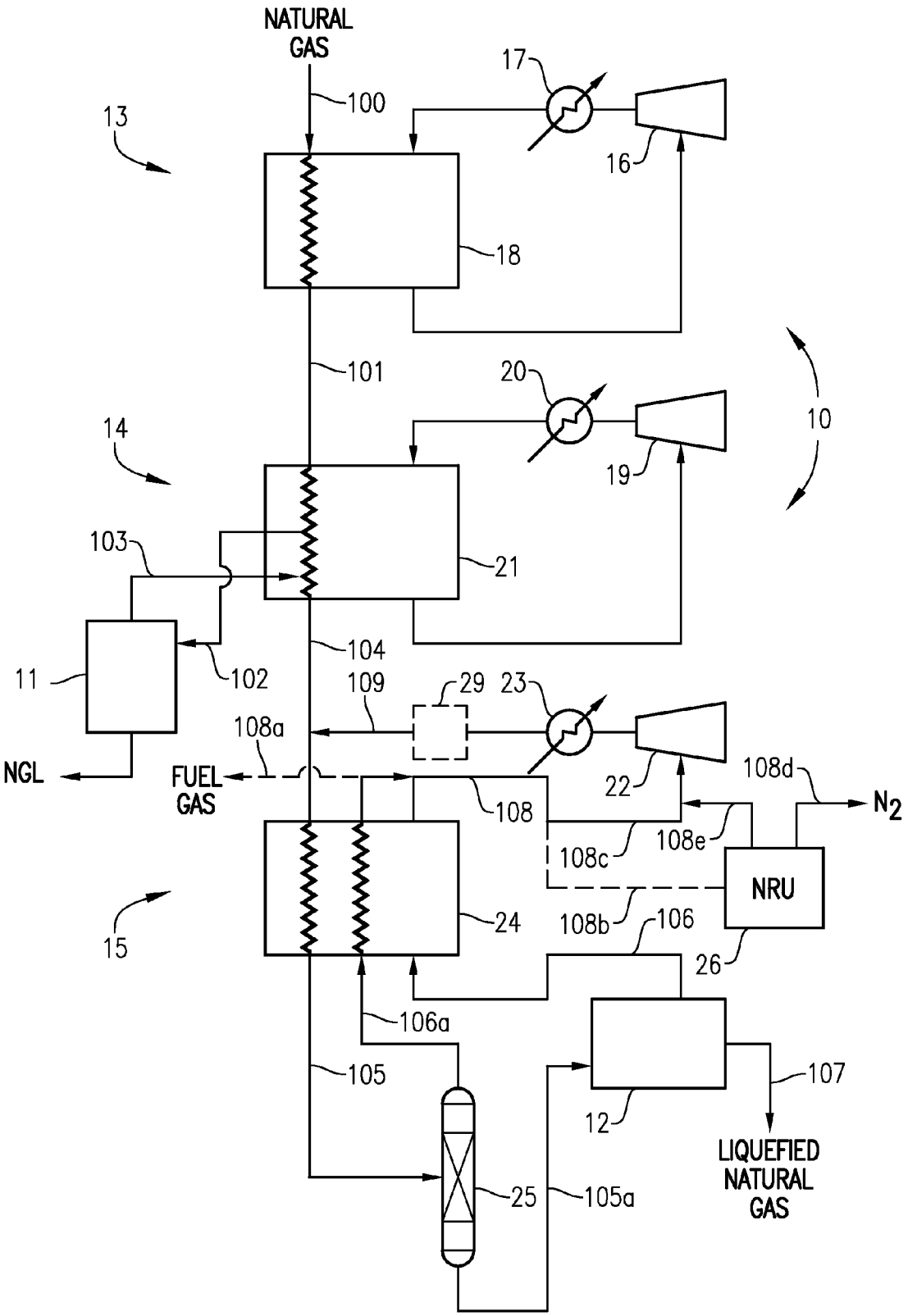
FIG. 1 is a simplified overview of a cascade-type LNG facility configured in accordance with one embodiment of the present invention.

FIG. 1 illustrates one embodiment of a simplified LNG facility employing an enhanced nitrogen removal system. The cascade LNG facility of FIG. 1 generally comprises a cascade cooling section 10, a heavies removal zone 11, and an expansion cooling section 12. Cascade cooling section 10 is depicted as comprising a first mechanical refrigeration cycle 13, a second mechanical refrigeration cycle 14, and a third mechanical refrigeration cycle 15. In general, first, second, and third refrigeration cycles 13, 14, 15 can each be operable to cool at least a portion of the natural gas stream entering the LNG facility. First, second, and third refrigeration cycles 13, 14, 15 can be closed-loop refrigeration cycles, open-loop refrigeration cycles, or any combination thereof. In one embodiment of the present invention, first and second refrigeration cycles 13 and 14 can be closed-loop cycles, and third refrigeration cycle 15 can be an open-loop cycle that utilizes a refrigerant comprising at least a portion of the natural gas feed stream undergoing liquefaction. When third refrigeration cycle 15 comprises an open-loop refrigeration cycle, as shown in FIG. 1, the LNG facility can additionally include a nitrogen removal unit (NRU) 26 to remove at least a portion of the nitrogen entering the system via the natural gas feed stream.

In accordance with one embodiment of the present invention, first, second, and third refrigeration cycles 13, 14, 15 can employ respective first, second, and third refrigerants having successively lower boiling points. For example, the first, second, and third refrigerants can have mid-range boiling points at standard pressure (i.e., mid-range standard boiling points) within about 10° C. (18° F.), within about 5° C. (9° F.), or within 2° C. (3.6° F.) of the standard boiling points of propane, ethylene, and methane, respectively. In one embodiment, the first refrigerant can comprise at least about 75 mole percent, at least about 90 mole percent, at least 95 mole percent, or can consist of or consist essentially of propane, propylene, or mixtures thereof. The second refrigerant can comprise at least about 75 mole percent, at least about 90 mole percent, at least 95 mole percent, or can consist of or consist essentially of ethane, ethylene, or mixtures thereof. The third refrigerant can comprise at least about 75 mole percent, at least about 90 mole percent, at least 95 mole percent, or can consist of or consist essentially of methane. In one embodiment, at least one of the first, second, and third refrigerants can be a mixed refrigerant. In another embodiment, at least one of the first, second, and third refrigerants can be a pure component refrigerant.

As shown in FIG. 1, first refrigeration cycle 13 can comprise a first refrigerant compressor 16, a first cooler 17, and a first refrigerant chiller 18. First refrigerant compressor 16 can discharge a stream of compressed first refrigerant, which can subsequently be cooled and at least partially liquefied in cooler 17. The resulting refrigerant stream can then enter first refrigerant chiller 18, wherein at least a portion of the refrigerant stream can cool the incoming natural gas stream in conduit 100 via indirect heat exchange with the vaporizing first refrigerant. The gaseous refrigerant can exit first refrigerant chiller 18 and can then be routed to an inlet port of first refrigerant compressor 16 to be recirculated as previously described.

First refrigerant chiller 18 can comprise one or more cooling stages operable to reduce the temperature of the incoming natural gas stream in conduit 100 by an amount in the range of from about 20° C. (36° F.) to about 120° C. (216° F.), about 25° C. (45° F.) to about 110° C. (198° F.), or 40° C. (72° F.) to 85° C. (153° F.). Typically, the natural gas entering first refrigerant chiller 18 via conduit 100 can have a temperature in the range of from about −20° C. (−4° F.) to about 95° C. (203° F.), about −10° C. (14° F.) to about 75° C. (167° F.), or 10° C. (50° F.) to 50° C. (122° F.). In general, the temperature of the cooled natural gas stream exiting first refrigerant chiller 18 can be in the range of from about −55° C. (−67° F.) to about −15° C. (5° F.), about −45° C. (−49° F.) to about −20° C. (−4° F.), or −40° C. (−40° F.) to −30° C. (−22° F.). In general, the pressure of the natural gas stream in conduit 100 can be in the range of from about 690 kPa (100.1 psi) to about 20,690 kPa (3,000.8 psi), about 1,725 kPa (250.2 psi) to about 6,900 kPa (1,000.8 psi), or 2,760 kPa (400.3 psi) to 5,500 kPa (797.7 psi). Because the pressure drop across first refrigerant chiller 18 can be less than about 690 kPa (100.1 psi), less than about 345 kPa (50 psi), or less than 175 kPa (25.4 psi), the cooled natural gas stream in conduit 101 can have substantially the same pressure as the natural gas stream in conduit 100.

As illustrated in FIG. 1, the cooled natural gas stream exiting first refrigeration cycle 13 can then enter second refrigeration cycle 14, which can comprise a second refrigerant compressor 19, a second cooler 20, and a second refrigerant chiller 21. A compressed refrigerant stream can be discharged from second refrigerant compressor 19 and can subsequently be cooled and at least partially liquefied in cooler 20 prior to entering second refrigerant chiller 21. Second refrigerant chiller 21 can employ a plurality of cooling stages to progressively reduce the temperature of the predominantly methane stream in conduit 101 by an amount in the range of from about 30° C. (54° F.) to about 100° C. (180° F.), about 35° C. (63° F.) to about 85° C. (153° F.), or 50° C. (90° F.) to 70° C. (126° F.). As shown in FIG. 1, the vaporized second refrigerant can then be returned to an inlet port of second refrigerant compressor 19 prior to being recirculated in second refrigeration cycle 14, as previously described.

The natural gas feed stream in conduit 100 will usually contain ethane and heavier components ($C_2$+), which can result in the formation of a $C_2$+ rich liquid phase during liquefaction. In order to remove the undesired heavies material from the predominantly methane stream prior to its complete liquefaction, at least a portion of the natural gas stream can pass through heavies removal zone 11, which can generally be located upstream of third refrigeration cycle 15. In one embodiment (not shown), the natural gas stream or portion thereof passing through heavies removal zone 11 can be withdrawn prior to entering, during passage through, or immediately after exiting first refrigeration cycle 13. In another embodiment (not shown), the natural gas stream or portion thereof passing through heavies removal zone 11 can be withdrawn prior to entering or immediately after exiting second refrigeration cycle 14. In yet another embodiment, the at least a portion of the cooled natural gas stream passing through second refrigerant chiller 21 can be withdrawn via conduit 102 and processed in heavies removal zone 11, as shown in FIG. 1. The stream in conduit 102 can have a temperature in the range of from about −10° C. (−166° F.) to about −45° C. (−49° F.), about −95° C. (−139° F.) to about −50° C. (−58° F.), or −85° C. (−121° F.) to −65° C. (−85° F.). Typically, the stream in conduit 102 can have pressure that is within about 5 percent, about 10 percent, or 15 percent of the pressure of the natural gas feed stream in conduit 100.

Heavies removal zone 11 can generally comprise one or more gas-liquid separators operable to remove at least a portion of the heavy hydrocarbon material from the cooled natural gas stream. Typically, heavies removal zone 11 can be operated to remove benzene and other high molecular weight aromatic components, which can freeze in subsequent liquefaction steps and plug downstream process equipment. In addition, heavies removal zone 11 can be operated to recover the heavy hydrocarbons in a natural gas liquids (NGL) product stream. Examples of typical hydrocarbon components included in NGL streams can include ethane, propane, butane isomers, pentane isomers, and hexane and heavier components (i.e., $C_6$+). The extent of NGL recovery from the predominantly methane stream ultimately impacts one or more final characteristics of the LNG product, such as, for example, Wobbe index, BTU content, higher heating value (HHV), ethane content, and the like. In one embodiment, the NGL product stream exiting heavies removal zone 11 can be subjected to further fractionation in order to obtain one or more pure component streams. Often, NGL product streams and/or their constituents can be used as gasoline blendstock.

As shown in FIG. 1, a heavies-depleted, predominantly methane stream can be withdrawn from heavies removal zone 11 via conduit 103 and can be routed back to second refrigeration cycle 14. Generally, the stream in conduit 103 can have a temperature in the range of from about −100° C. (−148° F.) to about −40° C. (−40° F.), about −90° C. (−130° F.) to about −50° C. (−58° F.), or −80° C. (−112° F.) to −55° C. (−67° F.). The pressure of the stream in conduit 103 can typically be in the range of from about 1,380 kPa (200.15 psi) to about 8,275 kPa (1200.2 psi), about 2,420 kPa (351 psi) to about 5,860 kPa (849.9 psi), or 3,450 kPa (500.4 psi) to 4,830 kPa (700.5 psi).

As shown in FIG. 1, the predominantly methane stream in conduit 103 can subsequently be further cooled via second refrigerant chiller 21. In one embodiment, the stream exiting second refrigerant chiller 21 via conduit 104 can be completely liquefied and can have a temperature in the range of from about −135° C. (−211° F.) to about −55° C. (−67° F.), about −115° C. (−175° F.) to about −65° C. (−85° F.), or −95° C. (−139° F.) to −85° C. (−121° F.). Generally, the stream in conduit 104 can be at approximately the same pressure the natural gas stream entering the LNG facility in conduit 100.

As illustrated in FIG. 1, the pressurized LNG-bearing stream in conduit 104 can combine with a yet-to-be-discussed stream in conduit 109 prior to entering third refrigeration cycle 15, which is depicted as generally comprising a third refrigerant compressor 22, a cooler 23, and a third refrigerant economizer 24. Compressed refrigerant discharged from third refrigerant compressor 22 enters cooler 23, wherein the refrigerant stream is cooled via indirect heat exchange prior to entering cooling zone 29. Cooling zone 29 can comprise one or more cooling stages operable to cool and at least partially condense the predominantly methane stream in conduit 109. In one embodiment, cooling zone 29 can be at least partly defined within one or more of the first or second refrigerant chillers 18, 21 and/or within third refrigerant economizer 24. When a portion of cooling zone 29 is defined within one or more of first, second, and third refrigeration cycles 13, 14, 15, in one embodiment, one or more of the refrigeration cycles can define one or more cooling passes.

As shown in FIG. 1, third refrigerant economizer 24 can comprise one or more cooling stages operable to subcool the pressurized predominantly methane stream via indirect heat exchange with the vaporizing refrigerant. In one embodiment, the temperature of the pressurized LNG-bearing stream in conduit 105 can be reduced by an amount in the range of from about 2° C. (3.6° F.) to about 35° C. (63° F.), about 3° C. (5.4° F.) to about 30° C. (54° F.), or 5° C. (9° F.) to 25° C. (45° F.) in third refrigerant economizer 24. Typically, the temperature of the pressurized LNG-bearing stream exiting third refrigerant economizer 24 can be in the range of from about −170° C. (−274° F.) to about −55° C. (−67° F.), about −145° C. (−229° F.) to about −70° C. (−94° F.), or −130° C. (−202° F.) to −85° C. (−121° F.).

As illustrated in FIG. 1, at least a portion of the cooled, LNG-bearing stream in conduit 105 exiting third refrigeration chiller 24 can be introduced into a fluid inlet of a multistage separation vessel 25. Multistage separation vessel 25 can comprise a plurality of mass-transfer surfaces, such as, for example, trays, plates, structured packing, random packing, or any combination thereof. In one embodiment, multistage separation vessel 25 can include a number of trays and/or amount of packing sufficient to provide in the range of from about 2 to about 30, about 3 to about 20, about 4 to about 15, or 5 to 10 theoretical mass and energy transfer stages (i.e., theoretical stages). Multistage separation vessel 25 can separate at least a portion of the cooled, LNG-bearing stream in conduit 105 into a predominantly vapor stream in conduit 106*a* and a predominantly liquid stream in 105*a*.

In general, multistage separation vessel 25 can be operable to remove at least a portion of the nitrogen from the cooled, LNG-bearing stream in conduit 105. In general, the ability of multistage separation vessel 25 to separate nitrogen from the pressurized LNG-bearing stream in conduit 105 can be expressed as the "nitrogen removal efficiency" of multistage separation vessel 25. The term "nitrogen removal efficiency" can be defined according to the following formula: (mass flow rate of nitrogen entering multistage separation vessel 25—mass flow rate of nitrogen in the predominantly liquid stream in conduit 105*a*)/(mass of nitrogen entering multistage separation vessel 25), expressed as a percentage. In one embodiment, multistage separation vessel 25 can have a nitrogen removal efficiency in the range of from about 35 to about 99.5 percent, about 45 to about 95 percent, about 55 to about 90 percent, or 60 to 80 percent.

In one embodiment, the overhead stream exiting multistage separation vessel 25 can have a nitrogen mole fraction that is at least about 1.25 times, at least about 1.5 times, at least about 2 times, at least about 4 times, at least 6 times greater than the nitrogen mole fraction of the feed stream to multistage separation vessel 25 in conduit 105. Generally, the multistage separation vessel feed stream in conduit 105 can have a nitrogen mole fraction in the range of from about 0.005 to about 0.20, about 0.01 to about 0.15, or 0.05 to 0.0, while the overhead stream exiting multistage separation vessel 25 via conduit 106*a* can have a nitrogen mole fraction in the range of from about 0.10 to about 0.50, about 0.15 to about 0.45, or 0.20 to 0.40.

Figure 2:
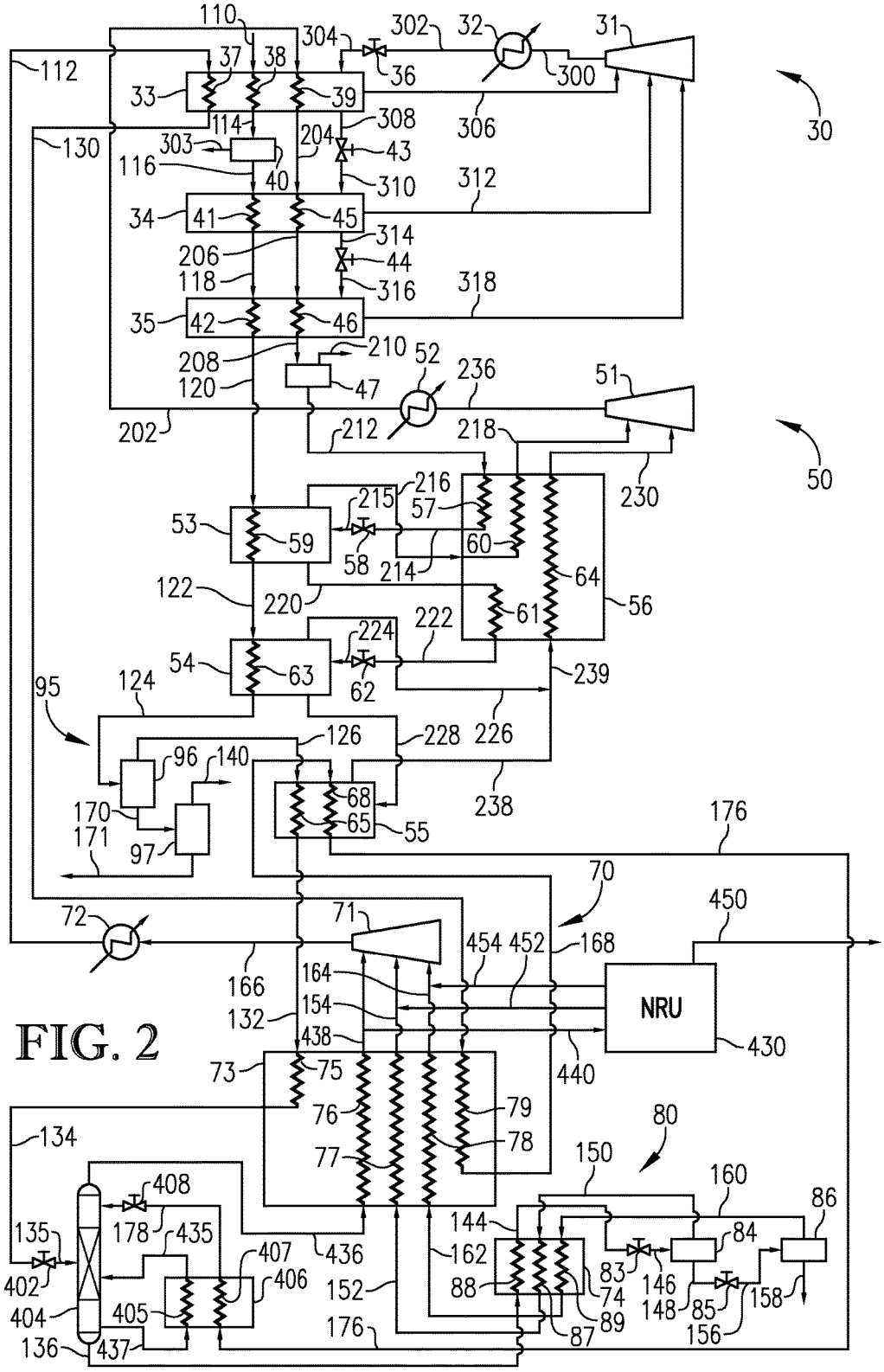
FIG. 2 is a schematic diagram of a cascade-type LNG facility configured in accordance with one embodiment of present invention.
Figure 3:
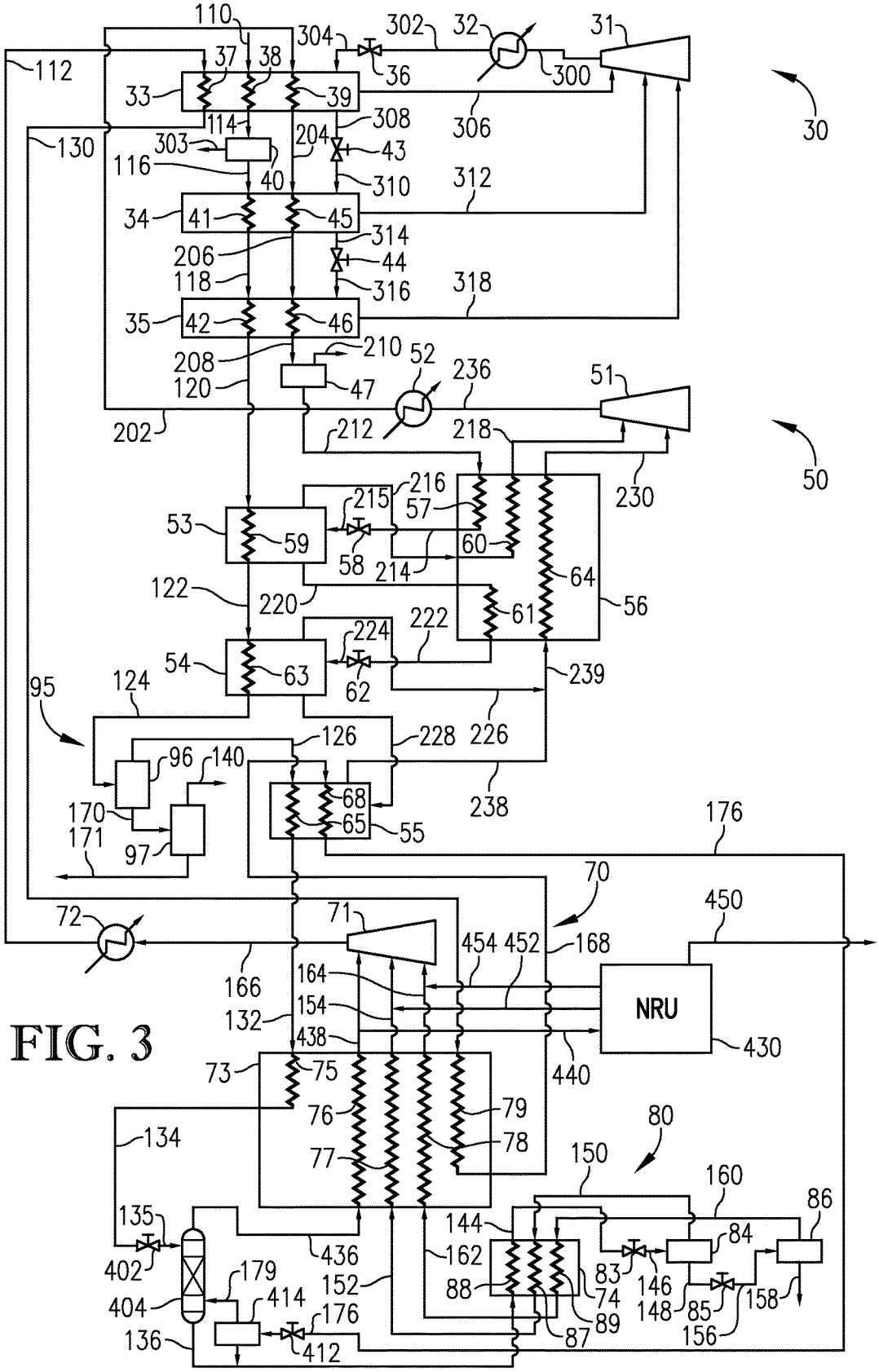
FIG. 3 is a schematic diagram of a cascade-type LNG facility configured in accordance with another embodiment of present invention.
Figure 4:
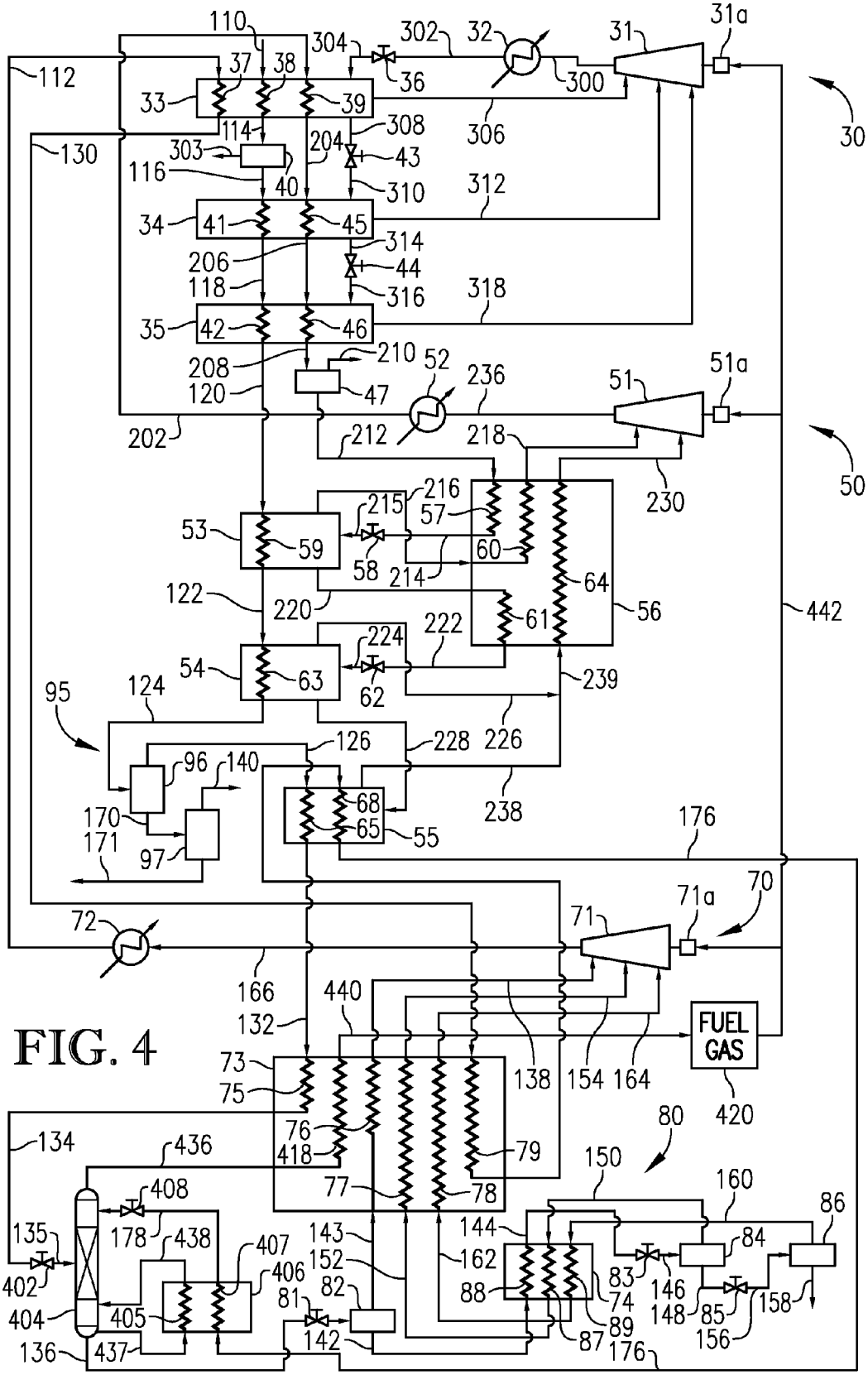
FIG. 4 is a schematic diagram of a cascade-type LNG facility configured in accordance with yet another embodiment of present invention.

In one embodiment, multistage separation vessel 25 can employ at least one separation enhancing stream to facilitate increased nitrogen removal. Examples of separation enhancing stream can include, for example, a reflux stream and/or a stripping gas stream. When the separation enhancing stream is a reflux stream, the separation enhancing stream can be introduced into multistage separation vessel 25 via a reflux inlet, located at or near the upper portion of multistage separation vessel 25. When the separation enhancing stream is a stripping gas stream, the separation enhancing stream can be introduced into a stripping gas inlet of multistage separation vessel 25, which can generally be located at or near the lower portion of multistage separation vessel 25. In one embodiment, at least a portion of the separation enhancing stream can have passed through multistage separation vessel 25, while, in another embodiment, the separation enhancing stream may have originated upstream of multistage separation vessel 25 (e.g., the separation enhancing stream may not have passed through multistage separation vessel 25.) In one embodiment, prior to entering multistage separation vessel 25, the separation enhancing stream can be cooled, separated, and/or passed through an expansion stage in order to affect the pressure, temperature, and/or vapor fraction of the separation enhancing stream. Several embodiments illustrating specific configurations of a cascade-type LNG facility comprising a third refrigeration cycle employing a multistage separation vessel having a separation enhancing stream are illustrated in FIGS. 2-4, which will be discussed in greater detail in a subsequent section.

Referring back to FIG. 1, the predominantly vapor stream exiting multistage separation vessel 25 in conduit 106*a* can have a temperature, measured at the upper vapor outlet of multistage separation vessel 25, in the range of from about −80° C. (−121° F.) to about −140° C. (−220° F.), about −85° C. (−121° F.) to about −130° C. (−202° F.), about −95° C. (−139° F.) to about −125° C. (−193° F.), or −110° C. (−148° F.) to −120° C. (−184° F.). Typically, the pressure of the stream exiting multistage separation vessel 25 via conduit 106*a* can be in the range of from about 1,515 kPa (219.7 psia) to about 2,140 kPa (310.4 psia), about 1,585 kPa (229.8 psia) to about 2,070 kPa (300.2 psia), or 1,720 kPa (249.5 psia) to 1,935 kPa (280.6 psia).

As shown in FIG. 1, at least a portion of the predominantly vapor overhead stream exiting multistage separation vessel 25 via conduit 106*a* can subsequently be routed into third refrigerant economizer 24, wherein the stream can act as a refrigerant to cool at least a portion of the natural gas stream entering third refrigerant economizer via conduit 104. In general, the warmed predominantly vapor stream in conduit 108 can be utilized at one or more locations within the LNG facility. In one embodiment, at least a portion of the resulting warned stream in exiting third refrigerant economizer 24 can be routed to the facility fuel gas system (not shown) via conduit 108*a*.

In another embodiment, also illustrated in FIG. 1, at least a portion of the warned predominantly vapor, nitrogen-rich stream exiting third refrigerant economizer 24 via conduit 108 can be split into two fractions. In one embodiment, at least a portion of the first or refrigerant fraction in conduit 108*a* can subsequently be introduced into the inlet (i.e., suction) port of third refrigerant compressor 22 via conduit 108*c*, while at least a portion of the second or removed fraction in conduit 108*b* can be routed to the warm fluid inlet of nitrogen removal unit (NRU) 26. In general, NRU 26 can be any system capable of removing at least a portion of the nitrogen in the predominantly methane stream in conduit 108*b*. One example of an NRU suitable for use with the present invention is described in U.S. Pat. No. 7,234,322, hereby incorporated by reference in its entirety, to the extent not inconsistent with the present disclosure. Generally, NRU 26 can be operable to produce a nitrogen-rich stream in conduit 108*d*, which can be routed to subsequent storage, processing, and/or further use, and a nitrogen-depleted stream in conduit 108*e*. In one embodiment illustrated in FIG. 1, at least a portion of the nitrogen-depleted stream in conduit 108*e* can subsequently be combined with the warmed predominantly methane vapor stream exiting third refrigeration chiller 24 in conduit 108*c*. The combined stream can then enter the suction port of third refrigeration compressor 22.

As shown in FIG. 1, the predominantly liquid stream in conduit 105*a* withdrawn from a lower liquid outlet of multistage separation vessel 25 can be routed to expansion cooling section 12, wherein the stream can be at least partially subcooled via sequential pressure reduction to near atmospheric pressure by passage through one or more expansion stages. Expansion cooling section 12 can comprise in the range of from about 1 to about 6, about 2 to about 5, or 3 to 4 expansion stages. In one embodiment, each expansion stage can reduce the temperature of the LNG-bearing stream by an amount in the range of from about 5° C. (9° F.) to about 35° C. (63° F.), about 7.5° C. (13.5° F.) to about 30° C. (54° F.), or 10° C. (18° F.) to 25° C. (45° F.). Each expansion stage comprises one or more expanders which reduce the pressure of the liquefied stream to thereby evaporate or flash a portion thereof. Examples of suitable expanders can include, but are not limited to, Joule-Thompson valves, venturi nozzles, and turboexpanders. In one embodiment of the present invention, expansion section 12 can reduce the pressure of the LNG-bearing stream in conduit 105 by an amount in the range of from about 520 kPa (75.4 psi) to about 3,100 kPa (449.6 psi), about 860 kPa (124.7 psi) to about 2,070 kPa (300.2 psi), or 1,030 kPa (149.4 psi) to 1,550 kPa (224.8 psi).

Each expansion stage may additionally employ one or more vapor-liquid separators operable to separate the vapor phase (i.e., the flash gas stream) from the cooled liquid stream. As previously discussed, third refrigeration cycle 15 can comprise an open-loop refrigeration cycle, closed-loop refrigeration cycle, or any combination thereof. When third refrigeration cycle 15 comprises a closed-loop refrigeration cycle, the flash gas stream can be used as fuel within the facility or routed downstream for storage, further processing, and/or disposal. When third refrigeration cycle 15 comprises an open-loop refrigeration cycle, at least a portion of the flash gas stream exiting expansion section 12 can be used as a refrigerant to accomplish at least a portion of the cooling of the natural gas stream in conduit 104. Generally, when third refrigerant cycle 15 comprises an open-loop cycle, the third refrigerant can comprise at least 50 weight percent, at least about 75 weight percent, or at least 90 weight percent of flash gas from expansion section 12, based on the total weight of the stream.

As shown in FIG. 1, a flash gas stream exiting expansion cooling section 12 via conduit 106 can be routed to third refrigerant economizer 24, wherein at least a portion of the flash gas stream can be used as a refrigerant to cool the incoming natural gas stream in conduit 104. The resulting warmed refrigerant stream can then combine with the warmed predominantly vapor stream from multistage separation vessel 25 in conduit 108. The combined stream can then be split into two portions and be introduced into the suction of third refrigerant compressor 22, as previously discussed. As shown in FIG. 1, third refrigerant compressor 22 can discharge a stream of compressed third refrigerant, which can thereafter be cooled in cooler 23. The resulting cooled predominantly methane refrigerant stream in conduit 109 exiting third refrigeration cycle 15 can then combine with the cooled, heavies-depleted predominantly methane stream in conduit 104 prior to entering third refrigerant economizer 24, as previously discussed.

In one embodiment depicted in FIG. 1, the liquid stream exiting expansion section 12 via conduit 107 can comprise LNG. In one embodiment, the LNG in conduit 107 can have a temperature in the range of from about −130° C. (−202° F.) to about −185° C. (−301° F.), about −145° C. (−229° F.) to about −170° C. (−274° F.), or −155° C. (−247° F.) to −165° C. (−265° F.) and a pressure in the range of from about 0 kPa (0 psia) to about 345 kPa (50 psia), about 35 kPa (5.1 psia) to about 210 kPa (30.5 psia), or 82.7 kPa (10.2 psia) to 210 kPa (20.3 psia).

According to one embodiment, the LNG in conduit 107 can comprise at least about 85 volume percent of methane, at least about 87.5 volume percent methane, at least about 90 volume percent methane, at least about 92 volume percent methane, at least about 95 volume percent methane, or at least 97 volume percent methane. In another embodiment, the LNG in conduit 107 can comprise less than about 15 volume percent ethane, less than about 10 volume percent ethane, less than about 7 volume percent ethane, or less than 5 volume percent ethane. In yet another embodiment, the LNG in conduit 107 can have less than about 2 volume percent $C_3^+$ material, less than about 1.5 volume percent $C_3^+$ material, less than about 1 volume percent $C_3^+$ material, or less than 0.5 volume percent $C_3^+$ material. In one embodiment (not shown), the LNG in conduit 107 can subsequently be routed to storage and/or shipped to another location via pipeline, ocean-going vessel, truck, or any other suitable transportation means. In one embodiment, at least a portion of the LNG can be subsequently vaporized for pipeline transportation or for use in applications requiring vapor-phase natural gas.

FIGS. 2 through 4 present several embodiments of specific configurations of the LNG facility described previously with respect to FIG. 1. To facilitate an understanding of FIGS. 2 through 4, the following numeric nomenclature was employed. Items numbered 31 through 49 are process vessels and equipment generally associated with first propane refrigeration cycle 30, and items numbered 51 through 69 are process vessels and equipment typically related to second ethylene refrigeration cycle 50. Items numbered 71 through 94 generally correspond to process vessels and equipment associated with third methane refrigeration cycle 70 and/or expansion section 80. Items numbered 96 through 99 can generally be process vessels and equipment associated with heavies removal zone 95. Items numbered 100 through 199 generally correspond to flow lines or conduits that contain predominantly methane streams. Items numbered 200 through 299 generally correspond to flow lines or conduits which contain predominantly ethylene streams. Items numbered 300 through 399 generally correspond to flow lines or conduits that contain predominantly propane streams. Items numbered 400 through 499 generally correspond to miscellaneous process vessels, equipment, or flow lines or conduits that contain streams predominating in one or more components other than methane, ethylene, or propane.

Referring to FIG. 2, a cascade-type LNG facility in accordance with one embodiment of the present invention is illustrated. The LNG facility depicted in FIG. 2 generally comprises a propane refrigeration cycle 30, an ethylene refrigeration cycle 50, a methane refrigeration cycle 70 with an expansion section 80, and a heavies removal zone 95. While "propane," "ethylene," and "methane" are used to refer to respective first, second, and third refrigerants, it should be understood that the embodiment illustrated in FIG. 2 and described herein can apply to any combination of suitable refrigerants. The main components of propane refrigeration cycle 30 include a propane compressor 31, a propane cooler 32, a high-stage propane chiller 33, an intermediate-stage propane chiller 34, and a low-stage propane chiller 35. The main components of ethylene refrigeration cycle 50 include an ethylene compressor 51, an ethylene cooler 52, a high-stage ethylene chiller 53, an optional first low-stage ethylene chiller 54, a second low-stage ethylene chiller/condenser 55, and an ethylene economizer 56. The main components of methane refrigeration cycle 70 include a methane compressor 71, a methane cooler 72, a main methane economizer 73, and a secondary methane economizer 74. Methane refrigeration cycle 70 is also illustrated as comprising a pre-flash expander 402, a multistage separation vessel 404, a multistage separation vessel reboiler 406, a reflux expander 408, and a nitrogen removal unit (NRU) 430. The main components of expansion section 80, an intermediate-stage methane expander 83, an intermediate-stage methane flash drum 84, a low-stage methane expander 85, and a low-stage methane flash drum 86.

The LNG facility of FIG. 2 also includes heavies removal zone located downstream of optional first low-stage ethylene chiller 54 for removing heavy hydrocarbon components from the processed natural gas and recovering the resulting natural gas liquids. The heavies removal zone 95 of FIG. 2 is shown as generally comprising a first distillation column 96 and a second distillation column 97.

The operation of the LNG facility illustrated in FIG. 2 will now be described in more detail, beginning with propane refrigeration cycle 30. Propane is compressed in multistage (e.g., three-stage) propane compressor 31 driven by, for example, a gas turbine driver (not illustrated). The three stages of compression preferably exist in a single unit, although each stage of compression may be a separate unit and the units mechanically coupled to be driven by a single driver. Upon compression, the propane is passed through conduit 300 to propane cooler 32, wherein it is cooled and liquefied via indirect heat exchange with an external fluid (e.g., air or water). A representative temperature and pressure of the liquefied propane refrigerant exiting cooler 32 is about 38° C. (100.4° F.) and about 1,310 kPa (190 psi). The stream from propane cooler 32 can then be passed through conduit 302 to a pressure reduction means, illustrated as expansion valve 36, wherein the pressure of the liquefied propane is reduced, thereby evaporating or flashing a portion thereof. The resulting two-phase stream then flows via conduit 304 into high-stage propane chiller 33. High stage propane chiller 33 uses indirect heat exchange means 37, 38, and 39 to cool respectively, the incoming gas streams, including a yet-to-be-discussed methane refrigerant stream in conduit 112, a natural gas feed stream in conduit 110, and a yet-to-be-discussed ethylene refrigerant stream in conduit 202 via indirect heat exchange with the vaporizing refrigerant. The cooled methane refrigerant stream exits high-stage propane chiller 33 via conduit 130 and can subsequently be routed to the inlet of main methane economizer 73, which will be discussed in greater detail in a subsequent section.

The cooled natural gas stream from high-stage propane chiller 33 (also referred to herein as the "methane-rich stream") flows via conduit 114 to a separation vessel 40, wherein the gaseous and liquid phases are separated. The liquid phase, which can be rich in propane and heavier components ($C_3$+), is removed via conduit 303. The predominately vapor phase exits separator 40 via conduit 116 and can then enter intermediate-stage propane chiller 34, wherein the stream is cooled in indirect heat exchange means 41 via indirect heat exchange with a yet-to-be-discussed propane refrigerant stream. The resulting two-phase methane-rich stream in conduit 118 can then be routed to low-stage propane chiller 35, wherein the stream can be further cooled via indirect heat exchange means 42. The resultant predominantly methane stream can then exit low-stage propane chiller 34 via conduit 120. Subsequently, the cooled methane-rich stream in conduit 120 can be routed to high-stage ethylene chiller 53, which will be discussed in more detail shortly.

The vaporized propane refrigerant exiting high-stage propane chiller 33 is returned to the high-stage inlet port of propane compressor 31 via conduit 306. The residual liquid propane refrigerant in high-stage propane chiller 33 can be passed via conduit 308 through a pressure reduction means, illustrated here as expansion valve 43, whereupon a portion of the liquefied refrigerant is flashed or vaporized. The resulting cooled, two-phase refrigerant stream can then enter intermediate-stage propane chiller 34 via conduit 310, thereby providing coolant for the natural gas stream and yet-to-be-discussed ethylene refrigerant stream entering intermediate-stage propane chiller 34. The vaporized propane refrigerant exits intermediate-stage propane chiller 34 via conduit 312 and can then enter the intermediate-stage inlet port of propane compressor 31. The remaining liquefied propane refrigerant exits intermediate-stage propane chiller 34 via conduit 314 and is passed through a pressure-reduction means, illustrated here as expansion valve 44, whereupon the pressure of the stream is reduced to thereby flash or vaporize a portion thereof. The resulting vapor-liquid refrigerant stream then enters low-stage propane chiller 35 via conduit 316 and cools the methane-rich and yet-to-be-discussed ethylene refrigerant streams entering low-stage propane chiller 35 via conduits 118 and 206, respectively. The vaporized propane refrigerant stream then exits low-stage propane chiller 35 and is routed to the low-stage inlet port of propane compressor 31 via conduit 318 wherein it is compressed and recycled as previously described.

As shown in FIG. 2, a stream of ethylene refrigerant in conduit 202 enters high-stage propane chiller, wherein the ethylene stream is cooled via indirect heat exchange means 39. The resulting cooled stream in conduit 204 then exits high-stage propane chiller 33, whereafter the stream enters intermediate-stage propane chiller 34. Upon entering intermediate-stage propane chiller 34, the ethylene refrigerant stream can be further cooled via indirect heat exchange means 45. The resulting cooled ethylene stream can then exit intermediate-stage propane chiller 34 prior to entering low-stage propane chiller 35 via conduit 206. In low-stage propane chiller 35, the ethylene refrigerant stream can be at least partially condensed, or condensed in its entirety, via indirect heat exchange means 46. The resulting stream exits low-stage propane chiller 35 via conduit 208 and can subsequently be routed to an accumulator 47, as shown in FIG. 2. The liquefied ethylene refrigerant stream exiting accumulator 47 via conduit 212 can have a representative temperature and pressure of about −30° C. (−22° F.) and about 2,032 kPa (295 psia).

Turning now to ethylene refrigeration cycle 50 in FIG. 2, the liquefied ethylene refrigerant stream in conduit 212 can enter ethylene economizer 56, wherein the stream can be further cooled by an indirect heat exchange means 57. The sub-cooled liquid ethylene stream in conduit 214 can then be routed through a pressure reduction means, illustrated here as expansion valve 58, whereupon the pressure of the stream is reduced to thereby flash or vaporize a portion thereof. The cooled, two-phase stream in conduit 215 can then enter high-stage ethylene chiller 53, wherein at least a portion of the ethylene refrigerant stream can vaporize to thereby cool the methane-rich stream entering an indirect heat exchange means 59 of high-stage ethylene chiller 53 via conduit 120. The vaporized and remaining liquefied refrigerant exit high-stage ethylene chiller 53 via respective conduits 216 and 220. The vaporized ethylene refrigerant in conduit 216 can re-enter ethylene economizer 56, wherein the stream can be warmed via an indirect heat exchange means 60 prior to entering the high-stage inlet port of ethylene compressor 51 via conduit 218, as shown in FIG. 9.

The remaining liquefied refrigerant in conduit 220 can re-enter ethylene economizer 56, wherein the stream can be further sub-cooled by an indirect heat exchange means 61. The resulting cooled refrigerant stream exits ethylene economizer 56 via conduit 222 and can subsequently be routed to a pressure reduction means, illustrated here as expansion valve 62, whereupon the pressure of the stream is reduced to thereby vaporize or flash a portion thereof. The resulting, cooled two-phase stream in conduit 224 enters optional first low-stage ethylene chiller 54, wherein the refrigerant stream can cool the natural gas stream in conduit 122 entering optional first low-stage ethylene chiller 54 via an indirect heat exchange means 63. As shown in FIG. 2, the resulting cooled methane-rich stream exiting intermediate stage ethylene chiller 54 can then be routed to heavies removal zone 95 via conduit 124. Heavies removal zone 95 will be discussed in detail in a subsequent section.

The vaporized ethylene refrigerant exits optional first low-stage ethylene chiller 54 via conduit 226, whereafter the stream can combine with a yet-to-be-discussed ethylene vapor stream in conduit 238. The combined stream in conduit 240 can enter ethylene economizer 56, wherein the stream is warmed in an indirect heat exchange means 64 prior to being fed into the low-stage inlet port of ethylene compressor 51 via conduit 230. As shown in FIG. 2, a stream of compressed ethylene refrigerant in conduit 236 can subsequently be routed to ethylene cooler 52, wherein the ethylene stream can be cooled via indirect heat exchange with an external fluid (e.g., water or air). The resulting, at least partially condensed ethylene stream can then be introduced via conduit 202 into high-stage propane chiller 33 for additional cooling as previously described.

The remaining liquefied ethylene refrigerant exits optional first low-stage ethylene chiller 54 via conduit 228 prior to entering second low-stage ethylene chiller/condenser 55, wherein the refrigerant can cool the methane-rich stream exiting heavies removal zone 95 via conduit 126 via indirect heat exchange means 65 in second low-stage ethylene chiller/condenser 55. As shown in FIG. 2, the vaporized ethylene refrigerant can then exit second low-stage ethylene chiller/condenser 55 via conduit 238 prior to combining with the vaporized ethylene exiting optional first low-stage ethylene chiller 54 and entering the low-stage inlet port of ethylene compressor 51, as previously discussed.

The cooled natural gas stream exiting low-stage ethylene chiller/condenser can also be referred to as the "pressurized LNG-bearing stream." As shown in FIG. 2, the pressurized LNG-bearing stream exits second low-stage ethylene chiller/condenser 55 via conduit 132 prior to entering main methane economizer 73, wherein the stream can be cooled in an indirect heat exchange means 75 via indirect heat exchange with one or more yet-to-be discussed methane refrigerant streams. The cooled, pressurized LNG-bearing stream can then exit main methane economizer 73 via conduit 134 and can thereafter pass through pre-flash expander 402, wherein the pressure of the stream can be reduced to vaporize or flash a portion thereof. The resulting two-phase stream in conduit 135 can then be introduced into a feed inlet of multistage separation vessel 404.

As shown in FIG. 2, a predominantly vapor stream can be withdrawn from the upper vapor outlet of multistage separation vessel 404 and can subsequently enter conduit 436, whereafter at least a portion of the predominantly vapor stream can enter a cool fluid inlet of indirect heat exchange means 76 in main methane economizer 73. At least a portion of the stream in indirect heat exchange means 76 can act as a refrigerant to cool at least a portion of the predominantly methane stream in indirect heat exchange means 75, as previously discussed. The resulting warmed vapor stream can exit a warm fluid outlet of indirect heat exchange means 76 via conduit 438 and, thereafter, at least a portion of the warmed stream can be routed via conduit 440 to the feed gas inlet of NRU 430, as illustrated in FIG. 2. Typically, NRU 430 can produce a nitrogen-rich stream and at least one nitrogen-depleted stream. In the embodiment, the nitrogen-rich stream exiting NRU 430 via conduit 450 can be removed from the facility via an atmospheric vent or flare (not shown). In another embodiment depicted in FIG. 2, NRU 430 can produce at least two nitrogen-depleted streams via conduits 452 and 454, which can respectively combine with yet-to-be-discussed warmed refrigerant streams exiting main methane economizer 73 via conduits 154 and 164. The resulting combined streams can then enter respective intermediate-stage and low-stage inlets of methane compressor 71, as shown in FIG. 2.

In one embodiment illustrated in FIG. 2, a predominantly liquid stream withdrawn from multistage separation vessel 404 via conduit 435 can be introduced into the cool fluid inlet of an indirect heat exchange means 405 of multistage separation vessel reboiler 406. The predominantly liquid stream can be warmed and at least partially vaporized via indirect heat exchange with a yet-to-be discussed stream entering a warm fluid inlet of indirect heat exchange means 407, as shown in FIG. 2. The resulting warmed stream exiting a warm fluid outlet of indirect heat exchange means 405 can thereafter be routed via conduit 437 to a lower inlet of multistage separation vessel 404, while the cooled stream exiting a cool fluid outlet of indirect heat exchange means 407 via conduit 178 can be passed through reflux expander 408 to thereby vaporize or flash a portion thereof. The resulting two-phase stream can then be introduced as a reflux stream via a reflux inlet of multistage separation vessel 404.

As illustrated in FIG. 2, a predominantly liquid stream withdrawn from a lower liquid outlet of multistage separation vessel 404 can be routed via conduit 136 into second methane economizer 74, wherein the predominantly methane stream can be cooled via indirect heat exchange means 88. The resulting cooled stream in conduit 144 can then be routed to a second expansion stage, illustrated here as intermediate-stage expander 83. Intermediate-stage expander 83 reduces the pressure of the methane stream passing therethrough to thereby reduce the temperature of the stream by vaporizing or flashing a portion thereof. The resulting two-phase methane-rich stream in conduit 146 can then enter intermediate-stage methane flash drum 84, wherein the liquid and vapor portions of the stream can be separated and can exit the intermediate-stage flash drum via respective conduits 148 and 150. The vapor portion (i.e., the intermediate-stage flash gas) in conduit 150 can re-enter secondary methane economizer 74, wherein the stream can be heated via an indirect heat exchange means 87. The warmed stream can then be routed via conduit 152 to main methane economizer 73, wherein the stream can be further warmed via an indirect heat exchange means 77. The warmed refrigerant stream, which can comprise at least a portion of the nitrogen-depleted stream exiting NRU 430 via conduit 452 as discussed previously, can then be routed to the inter-stage inlet port of methane compressor 71 via conduit 154, as illustrated in FIG. 2.

The liquid stream exiting intermediate-stage methane flash drum 84 via conduit 148 can then pass through a low-stage expander 85, whereupon the pressure of the liquefied methane-rich stream can be further reduced to thereby vaporize or flash a portion thereof. The resulting cooled, two-phase stream in conduit 156 can then enter low-stage methane flash drum 86, wherein the vapor and liquid phases can be separated. The liquid stream exiting low-stage methane flash drum 86 can comprise liquefied natural gas (LNG). The LNG, which can be at about atmospheric pressure, can be routed via conduit 158 downstream for subsequent storage, transportation, and/or use.

The vapor stream exiting low-stage methane flash drum (i.e., the low-stage methane flash gas) in conduit 160 can be routed to secondary methane economizer 74, wherein the stream can be warmed via an indirect heat exchange means 89. The resulting stream can exit secondary methane economizer 74 via conduit 162, whereafter the stream can be routed to main methane economizer 73 to be further heated via indirect heat exchange means 78. The warmed methane vapor stream exiting main methane economizer 73 via conduit 164, which, as discussed previously, can comprise at least a portion of the nitrogen-depleted stream exiting NRU 430 via conduit 454, can then be routed to the low-stage inlet port of methane compressor 71, as shown in FIG. 2.

Generally, methane compressor 71 can comprise one or more compression stages. In one embodiment, methane compressor 71 comprises three compression stages in a single module. In another embodiment, the compression modules can be separate, but can be mechanically coupled to a common driver. Generally, when methane compressor 71 comprises two or more compression stages, one or more intercoolers (not shown) can be provided between subsequent compression stages. As shown in FIG. 2, the compressed methane refrigerant stream exiting methane compressor 71 can be discharged into conduit 166, whereafter the stream can be cooled via indirect heat exchange with an external fluid (e.g., air or water) in methane cooler 72. The cooled methane refrigerant stream exiting methane cooler 72 can then enter conduit 112, whereafter the methane refrigerant stream can be further cooled in propane refrigeration cycle 30, as described in detail previously.

Upon being cooled in propane refrigeration cycle 30, the methane refrigerant stream can be discharged into conduit 130 and subsequently routed to main methane economizer 73, wherein the stream can be further cooled via indirect heat exchange means 79. The resulting cooled stream exits main methane economizer 73 via conduit 168 and at least a portion of the stream can thereafter be introduced into a warm fluid inlet of indirect heat exchange means 68 in second low-stage ethylene chiller-condenser 55, wherein the stream can be cooled and at least partially condensed or can be subcooled via indirect heat exchange with the vaporizing ethylene refrigerant, as previously discussed. The resulting cooled stream can exit a cool fluid outlet of indirect heat exchange means 68 and at least a portion of the stream can enter conduit 176. Thereafter, at least a portion of the stream in conduit 176, which can be further cooled in heat exchanger 406 via indirect heat exchange means 407 can subsequently be introduced into multistage separation vessel 404 as a reflux stream, as discussed in detail previously.

Turning now to heavies removal zone 95, at least a portion of the predominantly methane stream withdrawn from optional first low-stage ethylene chiller 54 via conduit 124 can subsequently be introduced into first distillation column 96. As shown in FIG. 2, at least a portion of a predominantly vapor overhead stream withdrawn from first distillation column 96 can subsequently be routed to second low-stage ethylene chiller condenser 55, wherein the stream can be further cooled via indirect heat exchange means 65, as discussed in detail previously. A predominantly liquid, heavies-rich bottoms stream withdrawn from first distillation column 96 via conduit 170 can then be introduced into second distillation column 97. The predominantly liquid bottoms stream exiting second distillation column 97 via conduit 171, which generally comprises NGL, can be routed out of heavies removal zone 95 for subsequent storage, processing, and/or future use. The predominantly vapor overhead stream withdrawn from second distillation column 97 can be routed via conduit 140 to one or more locations within the LNG facility. In one embodiment, the stream can be introduced into the high-stage suction port of methane compressor 71. In another embodiment, the stream can be routed to storage or subjected to further processing and/or use.

Referring now to FIG. 3, an LNG facility configured in accordance with another embodiment of the present invention is illustrated. The main components of the LNG facility depicted in FIG. 3 are the same as those previously described with respect to FIG. 2 except the LNG facility depicted in FIG. 3 does not include reflux expander 408 and additionally comprises a stripping gas expander 412 and a stripping gas separator 414. The operation of the LNG facility presented in FIG. 3, as it differs from the operation of the facility previously described with respect to FIG. 2, will now be described in detail.

Turning to indirect heat exchange means 68 of second low-stage ethylene chiller/condenser 55 illustrated in FIG. 3, the cooled predominantly methane stream exiting the cool fluid outlet of indirect heat exchange means 68 via conduit 176 can subsequently be passed through stripping gas expander 412 to thereby vaporize or flash a portion of the stream. The resulting two-phase stream can then enter a fluid inlet of separation vessel 414, whereafter the vapor and liquid portions of the stream can be separated. As shown in FIG. 3, a predominantly vapor stream withdrawn via conduit 179 can be introduced into a stripping gas inlet of multistage separation vessel 404 as a stripping gas stream, while the predominantly liquid stream exiting separation vessel 414 can be combined with the predominantly liquid bottoms stream exiting multistage separation vessel 404. As illustrated in FIG. 3, the combined predominantly liquid stream can thereafter be routed to secondary methane economizer 74 and can be further processed as discussed in detail previously, with respect to FIG. 2.

Referring now to FIG. 4, an LNG facility configured in accordance with yet another embodiment of the present invention is illustrated. The main components of the LNG facility depicted in FIG. 4 are the same as those previously described with respect to FIG. 2, except the LNG facility depicted in FIG. 4 does not include NRU 430 and additionally comprises a high-stage methane expander 81, a high-stage methane flash drum 82, and a fuel gas system 420. In addition, gas turbines 31*a*, 51*a*, and 71*a*, which power respective propane, ethylene, and methane compressors 31, 51, and 71, are illustrated in the LNG facility depicted in FIG. 4. In one embodiment, the LNG facility depicted in FIG. 4 can be utilized in an LNG facility that does not have an NRU or is not currently utilizing its NRU. Typically, LNG facilities that do not have or do not employ an NRU can process natural gas feed streams having nitrogen concentrations of less than about 5 mole percent nitrogen, less than about 2.5 mole percent nitrogen, or less than 1.5 mole percent nitrogen. The operation of the LNG facility presented in FIG. 4, as it differs from the operation of the facility previously described with respect to FIG. 2, will now be described in detail.

Turning to indirect heat exchange means 75 of main methane economizer 73, at least a portion of the cooled, pressurized LNG-bearing stream exiting a cool fluid outlet of indirect heat exchange means 75 via conduit 134 can pass through pre-flash expander 402 to thereby vaporize or flash a portion of the stream. The resulting two-phase stream can then be introduced into a fluid inlet of multistage separation vessel 404. A predominantly vapor stream can be withdrawn from multistage separation vessel 404 via conduit 436 and can thereafter be routed to main methane economizer 73, as shown in FIG. 4. The predominantly vapor stream entering main methane economizer 73 can enter a cool fluid inlet of an indirect heat exchange means 418, wherein at least a portion of the stream can act as a refrigerant to cool at least a portion of the streams in indirect heat exchange means 75 and/or 79. The warmed predominantly vapor stream can thereafter exit a warm fluid outlet of indirect heat exchange means 418 and can then be routed to a feed gas inlet of a fuel gas system 420. At least a portion of the stream in conduit 440 introduced into fuel gas system 420 can be utilized as fuel for at least one of gas turbines 31*a*, 51*a*, 71*a*, as depicted in FIG. 4.

As illustrated in FIG. 4, at least a portion of the predominantly liquid stream withdrawn from a lower liquid outlet of multistage separation vessel 404 can subsequently be routed via conduit 136 through high-stage methane expander 81, whereupon the pressure of the stream can be reduced to thereby vaporize or flash a portion thereof. The resulting two-phase stream can then be routed to a fluid inlet of high-stage methane flash drum 82, wherein the vapor and liquid portions of the stream can be separated. As shown in FIG. 4, the predominantly vapor stream exiting an upper outlet of high-stage flash drum 82 via conduit 143 can subsequently be introduced into a cool fluid inlet of indirect heat exchange means 76 of main methane economizer 73, wherein at least a portion of the stream can be used as a refrigerant to cool one or more fluid streams in main methane economizer 73. At least a portion of the resulting warmed stream exiting a warm fluid outlet of main methane economizer 73 via conduit 138 can thereafter be routed to the high-stage suction port of methane compressor 71, wherein the stream can be pressurized. The resulting compressed predominantly methane stream can thereafter continue through the facility as previously described with respect to FIG. 2. As shown in FIG. 4, at least a portion of the predominantly liquid stream exiting high-stage methane flash drum 82 via conduit 142 can be routed to secondary methane economizer 74 and can continue through expansion cooling section 80 of methane refrigeration cycle 70 as previously discussed with respect to FIG. 2.

In one embodiment of the present invention, the LNG production systems illustrated in FIGS. 2 through 4 are simulated on a computer using conventional process simulation software in order to generate process simulation data in a human-readable form. In one embodiment, the process simulation data can be in the form of a computer print out. In another embodiment, the process simulation data can be displayed on a screen, a monitor, or other viewing device. The simulation data can then be used to manipulate the LNG system. In one embodiment, the simulation results can be used to design a new LNG facility and/or revamp or expand an existing facility. In another embodiment, the simulation results can be used to optimize the LNG facility according to one or more operating parameters. Examples of suitable software for producing the simulation results include HYSYS™ or Aspen Plus® from Aspen Technology, Inc., and PRO/II® from Simulation Sciences Inc.

Numerical Ranges

The present description uses numerical ranges to quantify certain parameters relating to the invention. It should be understood that when numerical ranges are provided, such ranges are to be construed as providing literal support for claim limitations that only recite the lower value of the range as well as claims limitation that only recite the upper value of the range. For example, a disclosed numerical range of 10 to 100 provides literal support for a claim reciting "greater than 10" or "at least 10" (with no upper bounds) and a claim reciting "less than 100" or "at most 100" (with no lower bounds).

Definitions

As used herein, the terms "a," "an," "the," and "said" mean one or more.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

As used herein, the term "cascade-type refrigeration process" refers to a refrigeration process that employs a plurality of refrigeration cycles, each employing a different pure component refrigerant to successively cool natural gas.

As used herein, the term "closed-loop refrigeration cycle" refers to a refrigeration cycle wherein substantially no refrigerant enters or exits the cycle during normal operation.

As used herein, the terms "comprising," "comprises," and "comprise" are open-ended transition terms used to transition from a subject recited before the term to one or elements recited after the term, where the element or elements listed after the transition terms are not necessarily the only elements that make up of the subject.

As used herein, the terms "containing," "contains." and "contain" have the same open-ended meaning as "comprising," "comprises," and "comprise," provided above.

As used herein, the terms "economizer" or "economizing heat exchanger" refer to a configuration utilizing a plurality of heat exchangers employing indirect heat exchange means to efficiently transfer heat between process streams.

As used herein, the term "fluid flow communication" between two components means that at least a portion of the fluid or material from the first component enters, passes through, or otherwise comes into contact with the second component.

As used herein, the terms "having," "has," and "have" have the same open-ended meaning as "comprising," "comprises," and "comprise," provided above.

As used herein, the terms "heavy hydrocarbon" and "heavies" refer to any component that is less volatile (i.e., has a higher boiling point) than methane.

As used herein, the terms "including," "includes," and "include" have the same open-ended meaning as "comprising," "comprises," and "comprise," provided above.

As used herein, the term "mid-range standard boiling point" refers to the temperature at which half of the weight of a mixture of physical components has been vaporized (i.e., boiled off) at standard pressure.

As used herein, the term "mixed refrigerant" refers to a refrigerant containing a plurality of different components, where no single component makes up more than 75 percent of the refrigerant.

As used herein, the term "natural gas" means a stream containing at least about 60 mole percent methane, with the balance being inerts, ethane, higher hydrocarbons, nitrogen, carbon dioxide, and/or a minor amount of other contaminants such as mercury, hydrogen sulfide, and mercaptan.

As used herein, the terms "natural gas liquids" or "NGL" refer to mixtures of hydrocarbons whose components are, for example, typically heavier than methane. Some examples of hydrocarbon components of NGL streams include ethane, propane, butane, and pentane isomers, benzene, toluene, and other aromatic compounds.

As used herein, the term "nitrogen mole fraction" refers to the moles of nitrogen relative to the total moles in a fluid stream.

As used herein, the term "open-loop refrigeration cycle" refers to a refrigeration cycle wherein at least a portion of the refrigerant employed during normal operation originates from the fluid being cooled by the refrigerant cycle.

As used herein, the terms "predominantly," "primarily," "principally," and "in major portion," when used to describe the presence of a particular component of a fluid stream, means that the fluid stream comprises at least 50 mole percent of the stated component. For example, a "predominantly" methane stream, a "primarily" methane stream, a stream "principally" comprised of methane, or a stream comprised "in major portion" of methane each denote a stream comprising at least 50 mole percent methane.

As used herein, the term "pure component refrigerant" means a refrigerant that is not a mixed refrigerant.

As used herein, the terms "upstream" and "downstream" refer to the relative positions of various components of a natural gas liquefaction facility along a fluid flow path in an LNG facility. For example, a component A is located downstream of another component B if component A is positioned along a fluid flow path that has already passed through component B. Likewise, component A is located upstream of component B if component A is located on a fluid flow path that has not yet passed through component B.

Claims not Limited to Disclosed Embodiments

The preferred forms of the invention described above are to be used as illustration only, and should not be used in a limiting sense to interpret the scope of the present invention. Modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

The invention claimed is:

1. A process for liquefying a natural gas stream in an LNG facility, the process comprising:

(a) cooling at least a portion of the natural gas stream in a plurality of upstream mechanical refrigeration cycles to form a predominantly natural gas stream wherein each upstream mechanical refrigeration cycle comprises a heat exchanger for providing indirect heat exchange with a pure component refrigerant for cooling the natural gas stream;

(b) introducing the predominantly natural gas stream to a heavies removal unit to remove a portion of the heavies from the predominantly natural gas stream to form a predominantly methane stream;

(c) after step (b) and downstream of the heavies removal unit, introducing the predominantly methane stream to an open-loop methane refrigeration cycle wherein the open-loop methane refrigeration cycle comprises an open-loop methatne refrigeration cycle heat exchanger, a refrigeration compressor, and a refrigerant chiller downstream of the refrigerant compressor;

(d) after (c) and downstream of the heavies removal unit, cooling the predominantly methane stream in the open-loop methane refrigeration heat exchanger;

(e) after (d) and downstream of the open-loop methane refrigeration cycle heat exchanger, separating at least a portion of the predominantly methane stream in a multistage separation vessel, wherein the multistage separation vessel comprises a plurality of mass transfer surfaces and a reboiler, to provide a predominantly vapor stream and a predominantly liquid stream, wherein at least a portion of the predominantly vapor stream is routed to a nitrogen removal unit; and (f) using the predominantly vapor stream as a refrigerant in the open-loop methane refrigeration cycle by introducing the predominantly vapor stream to a warming pass of the open-loop methane refrigeration cycle heat exchanger for cooling the predominantly methane stream in step (d);

(g) after step (f)and downstream of the warming pass of the open-loop methane refrigeration cycle heat exchanger, compressing the refrigerant in the refrigeration compressor; (h) cooling the refrigerant in the refrigeration chiller;

(i) after step (h), introducing the refrigerant to a cooling pass of at least one of the plurality of heat exchangers of the upstream mechanical refrigeration cycles to form a reboiler duty stream;

(j) introducing the reboiler duty stream to a warming pass of the reboiler to provide a reboiler duty for the multistage separation vessel to form a cold reflux stream;

(k) introducing the cold reflux stream to the multistage separation vessel to provide reflux to the multi stage separation vessel; and (l) withdrawing at least a portion of the predominantly liquid product stream as a liquefied natural gas product.

2. The process of claim 1, wherein (i) comprises introducing the chilled compressed refrigerant to a cooling pass of at least two of the plurality of heat exchangers of the upstream mechanical refrigeration cycles to form a reboiler duty stream.

3. The process of claim 1, further comprising introducing at least a portion of the predominantly vapor stream into a nitrogen removal unit.

4. The process of claim 1, wherein the heavies removal unit comprises a heavies removal column located upstream of the open-loop methane refrigeration cycle to separate the predominantly methane stream into a heavies-depleted stream and a heavies-rich stream, wherein the at least a portion of the predominantly methane stream introduced into the open-loop methane refrigeration cycle heat exchanger comprises at least a portion of the heavies-depleted stream.

5. The process of claim 4, wherein the nitrogen mole fraction of the predominantly vapor stream is at least about 1.25 times greater than the nitrogen mole fraction of the predominantly methane stream introduced to the multistage separation vessel.

6. The process of claim 4, wherein the nitrogen mole fraction of the predominately vapor stream is at least 2 times greater than the nitrogen mole fraction of the cooled predominately methane stream introduced into the multistage separation vessel.

7. The process of claim 1, wherein the predominately methane stream introduced into the multistage separation vessel has a nitrogen concentration of less than about 15 mole percent, wherein the predominately vapor stream has a nitrogen concentration of at least 20 mole percent.

8. The process of claim 7, wherein the predominately vapor stream has a nitrogen concentration of at least 30 mole percent.

9. The process of claim 1, further comprising flashing at least a portion of the predominately liquid stream to provide a two-phase stream and using at least a portion of the two-phase stream to at least partially perform the cooling of step (f).

10. The process of claim 1, further comprising flashing the predominately methane stream prior to introduction into the multistage separation vessel.

11. The process of claim 1, wherein the multistage separation vessel comprises at least three theoretical stages.

12. The process of claim 1, further comprising withdrawing a portion of the predominantly vapor stream to form a nitrogen rejection unit feed and introducing the nitrogen rejection unit feed to a nitrogen rejection unit.

13. The process of claim 1, further comprising withdrawing a liquid stream from the lower portion of the multistage separation vessel and warming at least a portion of the withdrawn liquid stream via indirect heat exchange with a reflux stream prior to introducing the reflux stream into the multistage separation vessel.

14. The process of claim 1, wherein the pure-component refrigerant is propane, propylene, ethane, or ethylene.

* * * * *